US007481660B1

(12) United States Patent
Tsai

(10) Patent No.: US 7,481,660 B1
(45) Date of Patent: Jan. 27, 2009

(54) ROTATABLE PLUG WITH FIXABLE CONVERTER

(75) Inventor: Sung-Nien Tsai, Jhonghe (TW)

(73) Assignee: Phihong Technology Co., Ltd., Taoyuan County (TW)

( * ) Notice: Subject to any disclaimer, the term of this patent is extended or adjusted under 35 U.S.C. 154(b) by 0 days.

(21) Appl. No.: 12/003,359

(22) Filed: Dec. 21, 2007

(51) Int. Cl.
*H01R 13/44* (2006.01)

(52) U.S. Cl. ..... 439/131; 439/651

(58) Field of Classification Search ..... 439/131, 439/172, 640, 651
See application file for complete search history.

(56) References Cited

U.S. PATENT DOCUMENTS 6,270,364 B1 * 8/2001 Wang ..... 439/131
6,275,002 B1 * 8/2001 Chen ..... 320/111
6,312,271 B1 * 11/2001 Tseng ..... 439/131
6,638,113 B2 * 10/2003 Kajiwara et al. ..... 439/651
6,722,900 B2 * 4/2004 Segawa et al. ..... 439/131
7,232,322 B1 * 6/2007 Yen et al. ..... 439/222
2002/0127918 A1 * 9/2002 Kajiwara et al. ..... 439/651

* cited by examiner

*Primary Examiner*—Thanh-Tam T Le
(74) *Attorney, Agent, or Firm*—Birch, Stewart, Kolasch & Birch, LLP

(57) ABSTRACT

A rotatable plug with a fixable converter includes a lower case having two through holes formed therein, two plug receiving slots opened in one end and two openings formed between the plug receiving slots; a plug having a longer end to be inserted into the through holes in the lower case, wherein the longer end of the plug is received in the plug receiving slots in the lower case when the plug is rotated to a hidden position; a locking member placed on the lower case and having two hook locks formed on the lower surface thereof; a fixing member having two clamping fixtures formed on the lower surface thereof to clamp the plug; and a converter having two hooks formed on the upper surface thereof, wherein the hooks pass through the openings in the lower case and then are locked by the hook locks of the locking member.

16 Claims, 6 Drawing Sheets

ROTATABLE PLUG WITH FIXABLE CONVERTER

FIELD OF THE INVENTION

The present invention relates to a rotatable plug, and more particularly to a rotatable plug with a fixable converter.

BACKGROUND OF THE INVENTION

Consumer electronic products, such as notebooks, personal digital assistants (PDA), mobile phones, MP3 players, and so on, are trending toward smaller sizes continuously, which thereby promotes higher demand for easily-portable electric power connectors, for example, a power supply, a battery charger, or a transformer. Therefore, the electric power connectors of consumer electronic products need to be made with smaller sizes and less weight, and more convenient for shipment. Furthermore, they must be durable in order to sustain long-term carrying and frequent usage. Each of the consumer electronic products needs a plug on the electric power connectors or on the product itself to supply power thereto, and thus the plug is a necessary unit. Various kinds of plugs come out recently for the consumer electronic products or the electric power connectors to be carried conveniently, such as rotatable plugs, foldable plugs, or retractable plugs.

For instance, a conventional electric power connector includes a housing and a plug. The housing further has a concave storage confinement near the top edge of the housing. The plug is mainly composed of a rod having a tenon on each side thereof, two first pins and two second pins. The first pins and the second pins respectively have holes corresponding to the tenon for inserting the tenon to make the connection of the first pins, the second pins and the rod. Each side wall of the concave storage confinement has a spring receptacle containing a spring. The ends of the spring are respectively in contact with a side of the spring receptacle and a cavity disposed in each of the first pins via a fixing element. The plug is positioned in the concave storage confinement by the resilience force of the springs and folded by adjusting the first pins to drive the second pins and rotate the rod. Thus, the plug is electrically connected to the circuit board mounted inside the housing.

Many conventional foldable, rotatable or retractable plugs similar to the above plug have a major difficulty in the mechanical design. The conventional foldable or rotatable fixtures usually have weak mechanical structure for attaching to either the housing or other members of the plug connector. The weak attachment structure may cause the foldable or rotatable unit to be damageable, less reliable and even dangerous to the user and may also affect the establishment or maintenance of a good electric contact. Moreover, conventional converters for different national standards usually couple with the plug through slots in the converters. Because there is no fixing mechanism between the converters and the plug, the converters often fall off the plug when in use, thereby causing the decrease in safety of the plug. Thus, there is still a demand for providing a rotatable plug cooperatable with a converter that is durable and safe and can overcome the above shortcomings.

SUMMARY OF THE INVENTION

In view of the aforementioned defects of the conventional plugs such as the weak mechanical structure rendering the conventional plug damageable, less reliable and even dangerous to the user and no fixing mechanism between the converters and the plug, the present invention discloses a rotatable plug with a fixable converter.

The present invention provides a rotatable plug with a fixable converter. In one aspect of the present invention, the rotatable plug with the fixable converter includes a lower case having two through holes formed therein, two plug receiving slots opened at one end and two openings formed between the plug receiving slots; a plug having a longer end to be inserted into the through holes in the lower case, wherein the longer end of the plug is received in the plug receiving slots in the lower case when the plug is rotated to a hidden position; a locking member placed on the lower case and having two hook locks formed on the lower surface thereof; a fixing member having two clamping fixtures formed on the lower surface thereof to clamp the plug; and a converter having two hooks formed on the upper surface thereof, wherein the hooks pass through the openings in the lower case and then are locked by the hook locks of the locking member. The rotatable plug with the fixable converter further includes an upper case engaged with the lower case and a printed circuit board (PCB) attached on the lower case. The upper case includes a circular projected hole formed therein. The rotatable plug with the fixable converter further includes a spring disposed between the locking member and the fixing member.

One advantage of the present invention is the rotatable plug which is conveniently receivable into an electric device.

Another advantage of the present invention is the rotatable plug which is effort-saving in use.

Still another advantage of the present invention is the rotatable plug which can meet the safety requirements.

Still another advantage of the present invention is the rotatable plug with the fixable converter which is durable and robust by utilizing the circular projected hole to fix the fixing member between the upper case and the lower case and can sustain long-term carrying and frequent usage.

Another advantage of the present invention is that the rotatable plug with the fixable converter can be applied to any kinds of electric devices which need an electric plug.

Still another advantage of the present invention is that the converter can be locked onto the rotatable plug by utilizing the locking member in the rotatable plug to increase steadiness of the converter when in use.

These and other advantages will become apparent from the following description of preferred embodiments taken together with the accompanying drawings and the appended claims.

BRIEF DESCRIPTION OF THE DRAWINGS

The present invention may be understood by some preferred embodiments and detailed descriptions in the specification and the attached drawings below. The identical reference numbers in the drawings refer to the same components in the present invention. However, it should be appreciated that all the preferred embodiments of the invention are only for illustrating but not for limiting the scope of the Claims and wherein:

DETAILED DESCRIPTION OF THE PREFERRED EMBODIMENT

The invention will now be described with the preferred embodiments and aspects and these descriptions interpret structure and procedures of the invention only for illustrating but not for limiting the Claims of the invention. Therefore, except the preferred embodiments in the specification, the present invention may also be widely used in other embodiments.

Figure 1:
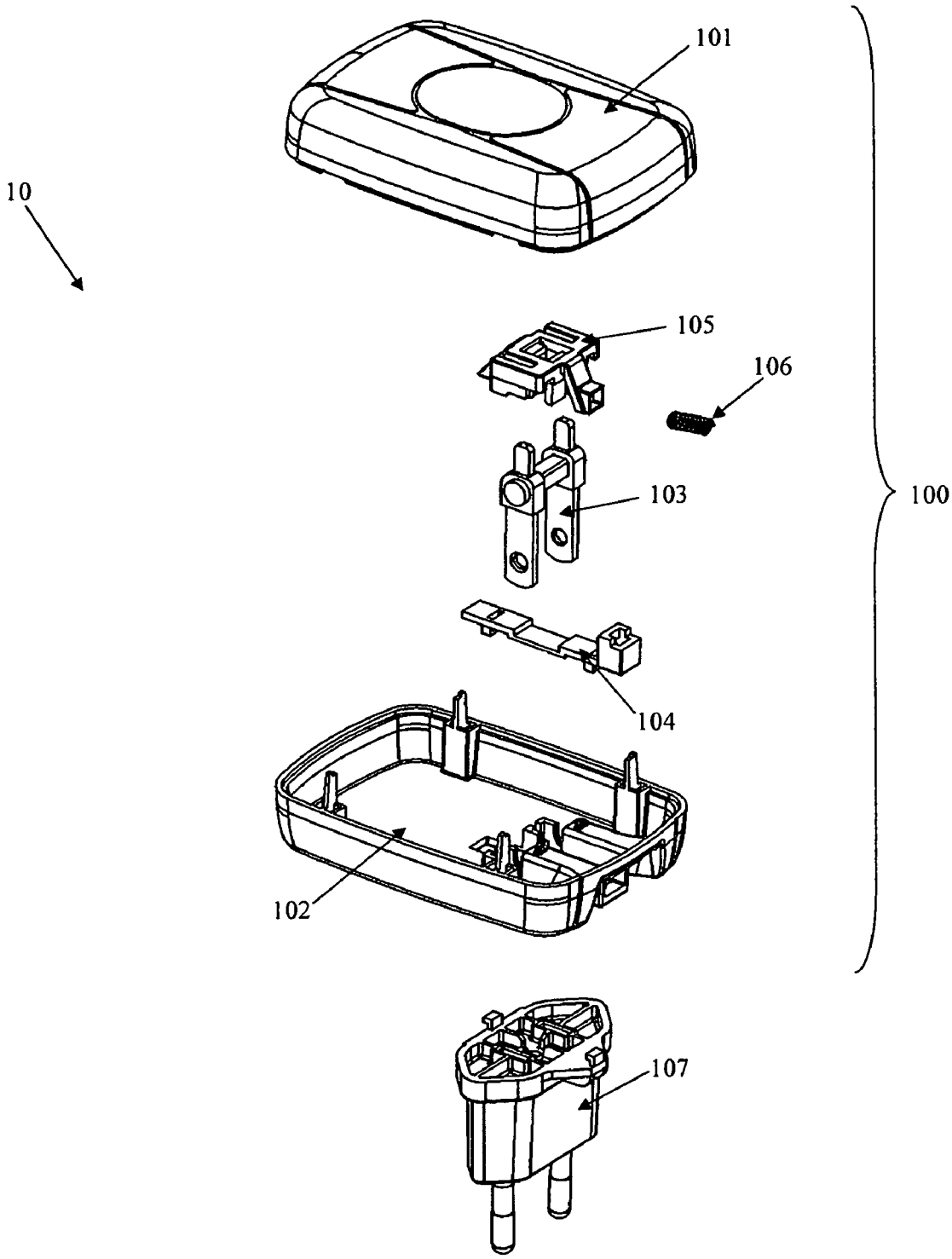
FIG. 1 is a diagram of a rotatable plug with a fixable converter according to the present invention.
Figure 2:
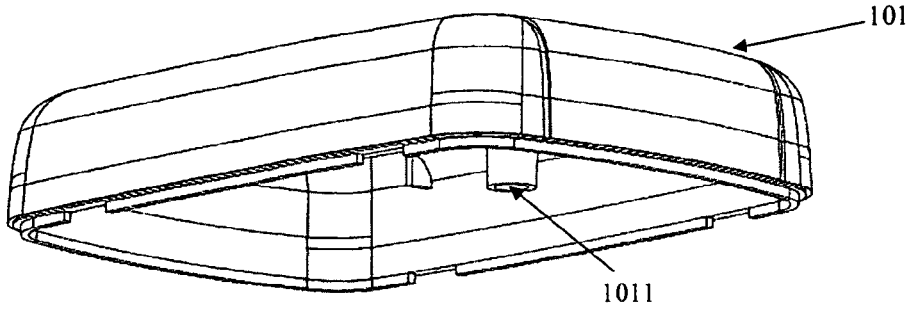
FIG. 2 is a diagram of an upper case of the rotatable plug with the fixable converter according to the present invention.
Figure 10:
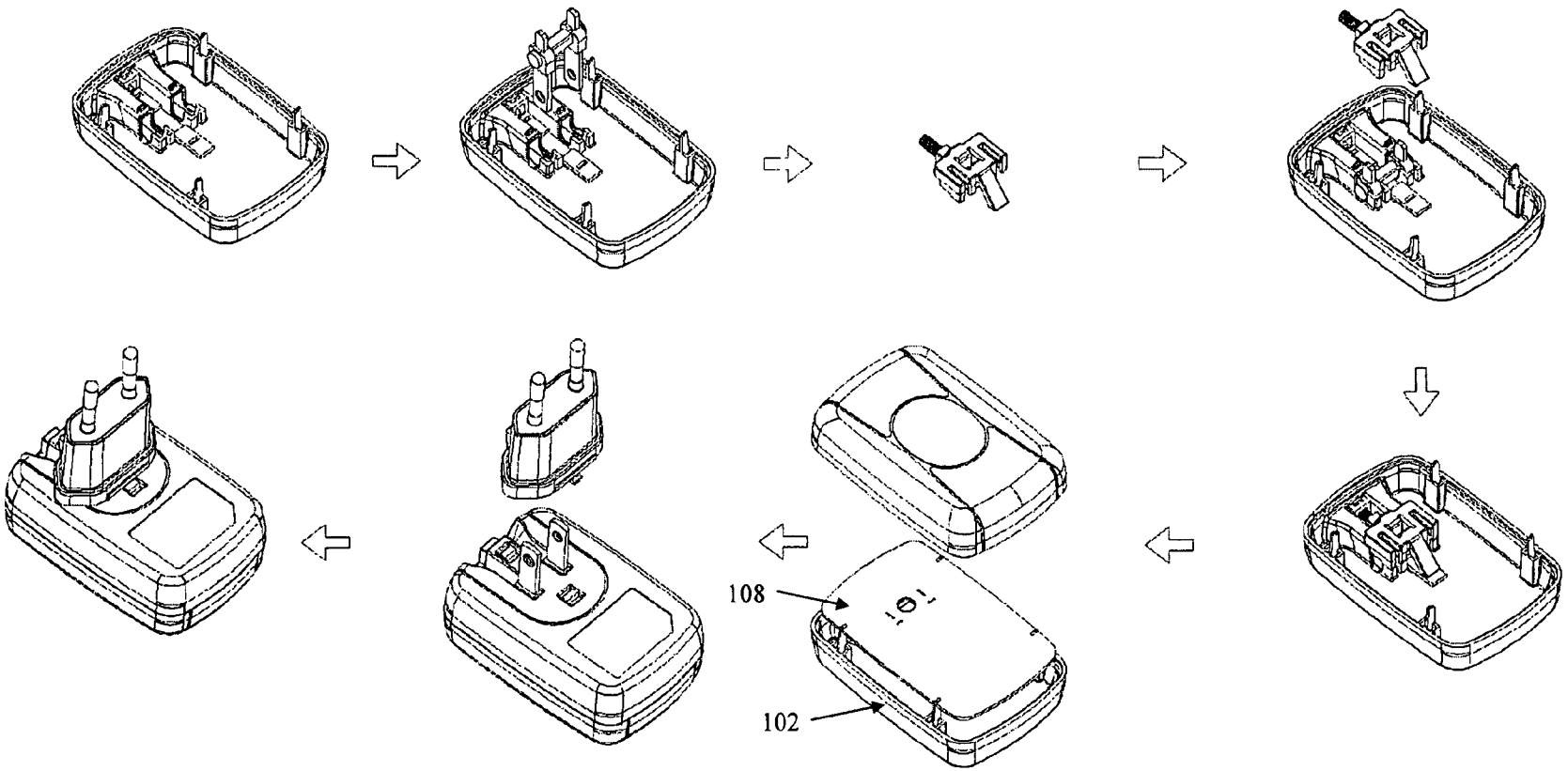
FIG. 10 illustrates the assembling process of the rotatable plug with the fixable converter according to the present invention.

The present invention discloses a rotatable plug with a fixable converter. As shown in FIG. 1, in a preferred embodiment of the present invention, the rotatable plug with the fixable converter 10 includes an upper case 101, a lower case 102 engaged with the upper case 101, a rotatable rack 103 supported by the lower case 102, a locking member 104 placed on the lower case 102, a fixing member 105 placed on the rotatable rack 103 and the locking member 104, a spring 106 disposed between the fixing member 105 and the locking member 104, and a converter 107 receiving the projected portion of the rotatable rack 103 and fixed onto the lower case 102 by the locking member 104. The rotatable plug with the fixable converter 10 further includes a printed circuit board (PCB) 108 attached on the lower case 102 to electrically connect with the rotatable rack 103, as shown in FIG. 10. The printed circuit board (PCB) 108 is attached parallel to the lower case 102. It should be appreciated that the printed circuit board (PCB) 108 can be attached either parallel or vertical to the lower case 102. In other words, as shown in FIG. 1 and FIG. 10, the rotatable plug 100 is constructed by the upper case 101, the lower case 102, the rotatable rack 103, the locking member 104, the fixing member 105, the spring 106, and the printer circuit board (PCB) 108. As shown in FIG. 3B, two slots 1021 are defined in the lower surface of the lower case 102. Slots 1021 are arranged parallelly and opened at one end for the rotatable rack 103 to pass through and be received therein. In other words, the rotatable rack 103 can be rotated into a position in which the rotatable rack 103 is received and hidden in the slots 1021. Moreover, the upper case 101 includes a circular projected hole 1011 formed therein, as shown in FIG. 2.

Figure 3A:
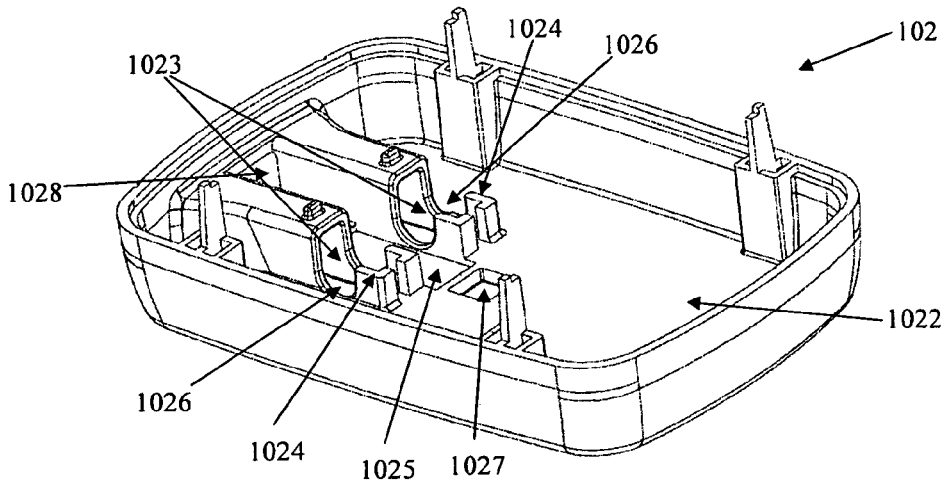
FIG. 3A and FIG. 3B are diagrams of a lower case of the rotatable plug with the fixable converter according to the present invention.
Figure 3B:
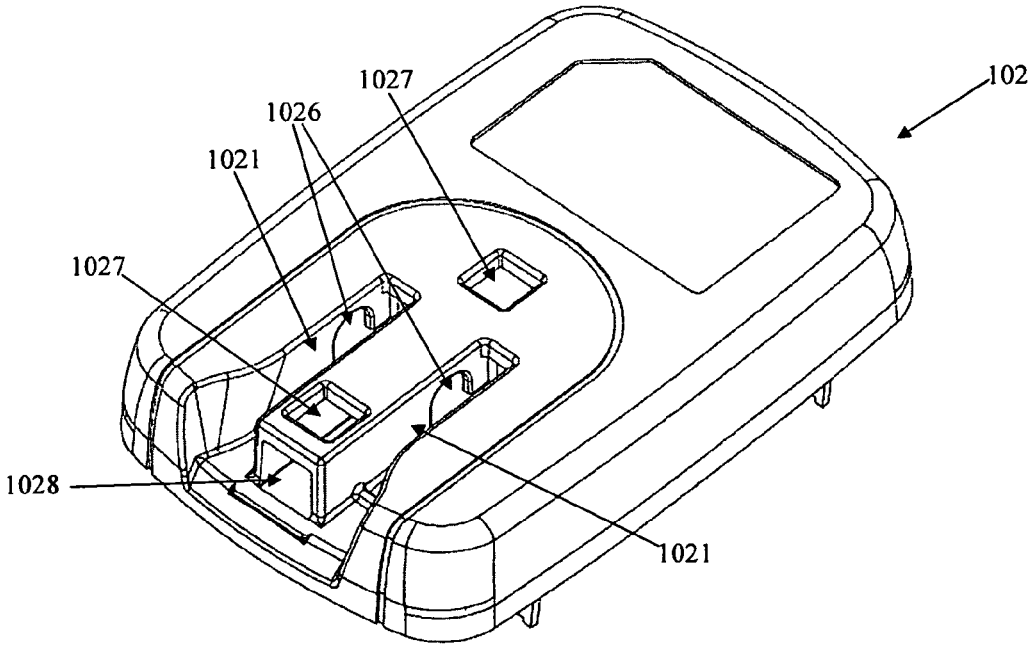

With reference to FIG. 3A and FIG. 3B, in the preferred embodiment of the present invention, the lower case 102 includes a base 1022, two through holes 1023 formed through the base 1022 for the rotatable rack 103 to be inserted therethrough, two receptacles 1024 formed adjacent to the through holes 1023 to receive a shorter end (as described below) of the rotatable rack 103, a groove 1025 formed between the two through holes 1023, four notches 1026 formed respectively on two sides of the two through holes 1023, two openings 1027 formed between the slots 1021 along a direction parallel to the slots 1021, and an opening 1028 formed between the slots 1021 and adjacent to the opened end of the slots 1021. Preferably, the shape of the notches 1026 is U-shaped.

Figure 4:
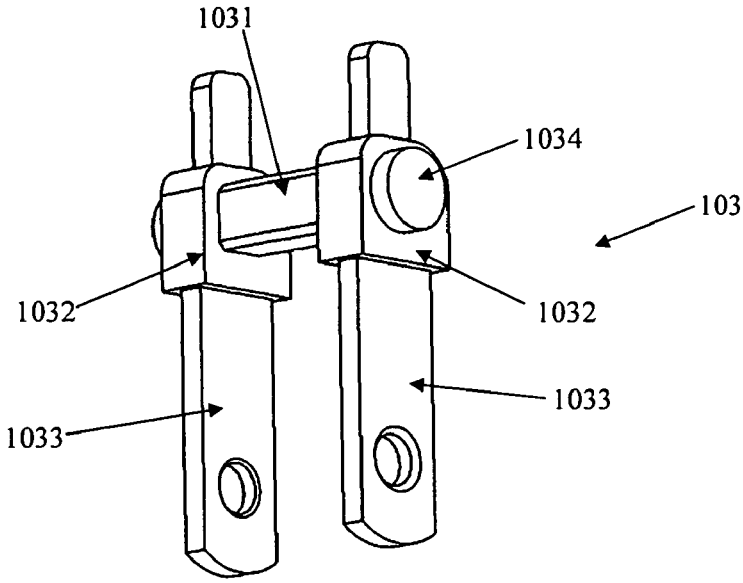
FIG. 4 is a diagram of a rotatable rack of the rotatable plug with the fixable converter according to the present invention.

With reference to FIG. 4, in the preferred embodiment of the present invention, the rotatable rack 103 includes a pivot 1031, two seats 1032 formed on opposite ends of the pivot 1031, two prongs 1033 fixed on the seats 1032 respectively, and two circular protrusions 1034 fixed to the seats 1032 on the outer side along the axis of the pivot 1031. The pivot 1031 is substantially a rectangular prism. Each seat 1032 has a slot (not shown) extending therethrough vertically to the axis of the pivot 1031, and an opening (not shown) extending therethrough parallel with the axis of the pivot 1031 and communicating with the slot (not shown). A shorter end of each prong 1033 is received and fixed in the slot (not shown), while the other longer end extends out and passes through the corresponding slots 1021 of the lower case 102. The longer ends of the prongs 1033 are inserted into the two through holes 1023 in the lower case 102 when the rotatable plug 100 is assembled. Furthermore, the pivot 1031 and the circular protrusions 1034 of the rack 103 are received and supported by the notches 1026 in the lower case 102. Therefore, the pivot 1031 can be rotated around the axis of the pivot 1031 and can slip smoothly into and out of the concave part (as described below) of the locking member 104, while the circular protrusions 1034 can be rotated around the axis of the pivot 1031 along with the pivot 1031 when the rack 103 is being rotated.

Figure 5:
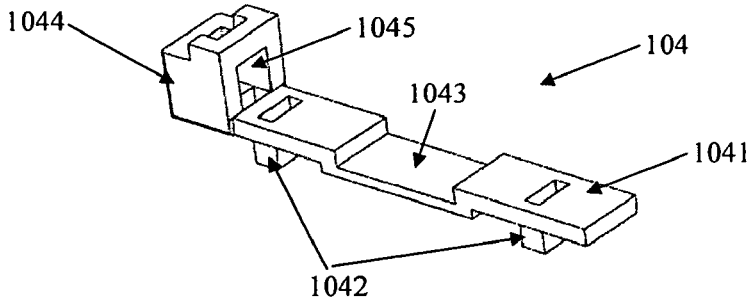
FIG. 5 is a diagram of a locking member of the rotatable plug with the fixable converter according to the present invention.

With reference to FIG. 5, in the preferred embodiment of the present invention, the locking member 104 includes a shank 1041, two hook locks 1042 formed on the lower surface of the shank 1041 and spaced apart, a concave part 1043 formed between the two hook locks 1042 and in the upper surface of the shank 1041, a button part 1044 formed at one end of the shank 1041, and a cavity 1045 formed in the inner side of the button part 1044. The hook locks 1042 are formed to be received by the openings 1027 in the lower case 102 when the rotatable plug 100 is assembled and to lock the hooks (as described below) of the converter 107 when the fixable converter 107 is attached, so as to fix the converter 107. The concave part 1043 is formed to be received by the groove 1025 in the lower case 102 when the rotatable plug 100 is assembled. The width of the groove 1025 is larger than that of the concave part 1043 to receive the concave part 1043. The button part 1044 is formed to be received by the opening 1028 in the lower case 102 when the rotatable plug 100 is assembled to form a button. The cavity 1045 is formed to receive one end of the spring 106 when the rotatable plug 100 is assembled.

Figure 6A:
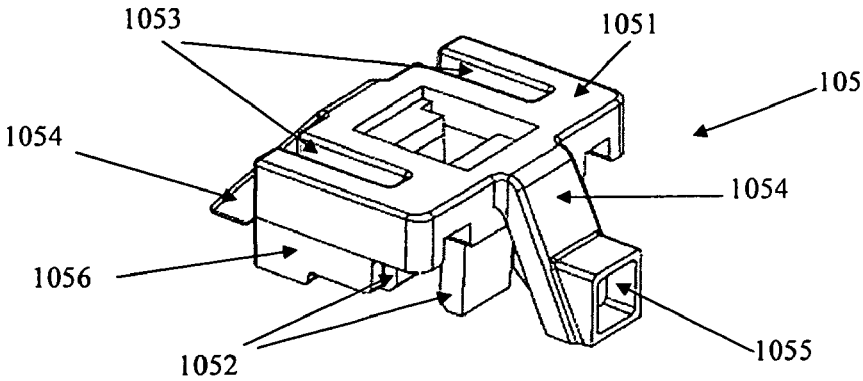
FIG. 6A and FIG. 6B are diagrams of a fixing member of the rotatable plug with the fixable converter according to the present invention.
Figure 6B:
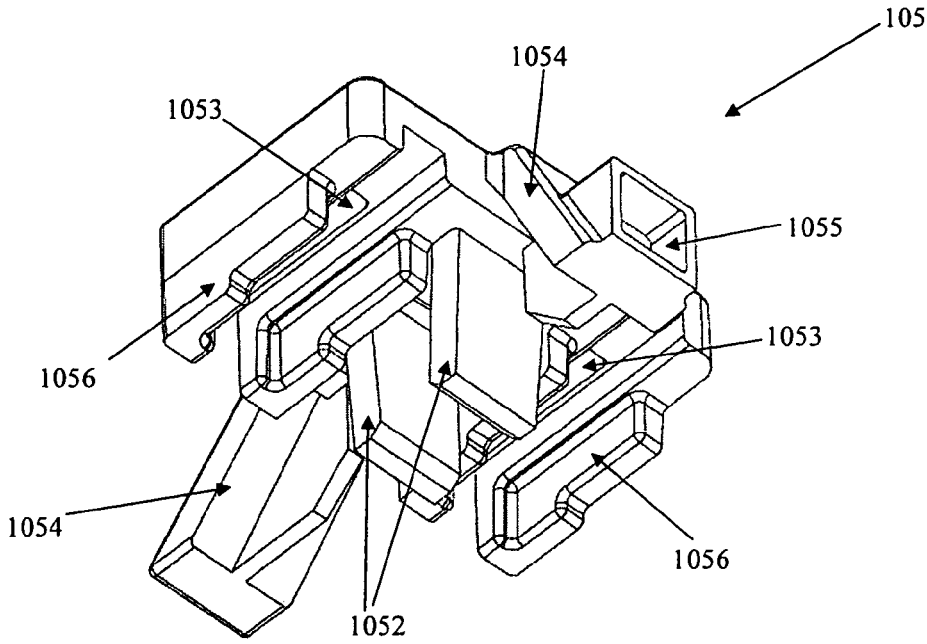

With reference to FIG. 6A and FIG. 6B, in the preferred embodiment of the present invention, the fixing member 105 includes a plate 1051, two clamping fixtures 1052 extending downward from the plate 1051, two slots 1053 formed oppositely in the edge of the plate 1051 and opened at one end, two inclined boards 1054 extending downward respectively from opposite sides of the plate 1051, a rectangular cavity 1055 formed at the bottom of one of the inclined boards 1054, and side walls 1056. The clamping fixtures 1052 clamp the pivot 1031 of the rotatable rack 103 to prevent the rack 103 from rotating away from the predetermined position. The distance between the end parts of the two clamping fixtures 1052 can be changed by the pivot 1031 when the rotatable rack 103 is being rotated because the clamping fixtures 1052 are flexible. The slots 1053 are formed to receive the shorter ends of the prongs 1033 when the rotatable plug 100 is assembled and when the rotatable rack 103 is being rotated. The rectangular cavity 1055 is formed to receive the other end of the spring 106 when the rotatable plug 100 is assembled.

Figure 7:
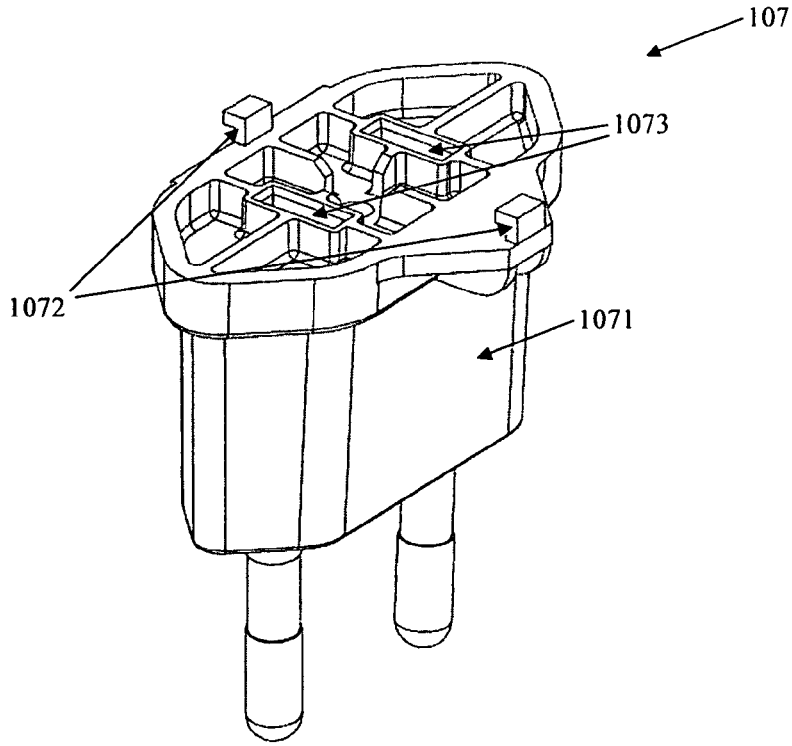
FIG. 7 is a diagram of the converter of the rotatable plug with the fixable converter according to the present invention.

As described above, one end of the spring 106 is received by the cavity 1045 of the locking member 104, and the other end of the spring 106 is received by the rectangular cavity 1055 of the fixing member 105, such that the spring 106 is disposed between the locking member 104 and the fixing member 105. With reference to FIG. 7, in one embodiment of the present invention, the fixable converter 107 includes a main body 1071 and two hooks 1072 formed oppositely on the upper surface of the main body 1071. The main body 1071 includes two narrow holes 1073 formed parallelly in the upper surface thereof and extending inward into the inner thereof, so as to receive the prongs 1033 of the rotatable rack 103 when the fixable converter 107 is attached. The hooks 1072 are formed to pass through the openings 1027 in the lower case 102 and then be locked by the hook locks 1042 of the locking member 104 when the fixable converter 107 is attached, so as to fix the converter 107 onto the lower case 102. It should be appreciated that the converter 107 can be any other kinds of converters for different national standards except the one shown in FIG. 7.

Figure 8:
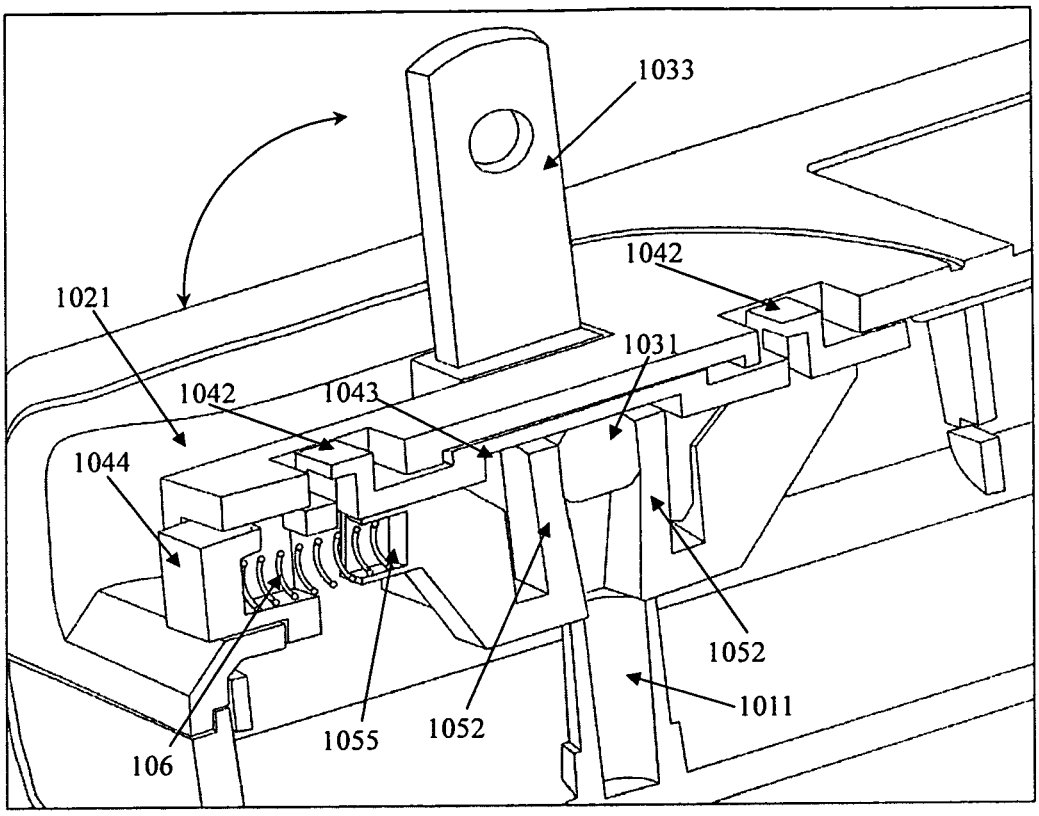
FIG. 8 illustrates the rotating mechanism of the rotatable plug with the fixable converter according to the present invention.

With reference to FIG. 8, in the assembled rotatable plug, the prongs 1033 can be rotated around the axis of the pivot 1031 from a hidden position at which the prongs 1033 are parallel to the lower surface of the lower case 102 and the longer ends of the prongs 1033 are received in the corresponding slots 1021 to a vertical position at which the prongs 1033 are vertical to the lower surface of the lower case 102 and the longer ends of the prongs 1033 are exposed out of the lower case 102, and vice versa. The shorter ends of the prongs 1033 pass through the slots 1053 of the fixing member 105 first, then enter the receptacles 1024 in the lower case 102 and are received therein while the longer ends of the prongs 1033 enter the slots 1021 in the lower surface of the lower case 102 and are received therein as the prongs 1033 are being rotated from the vertical position to the hidden position. Moreover, the pivot 1031 is substantially a rectangular prism. Therefore, the two clamping fixtures 1052 can clamp the pivot 1031 on two opposite planes of the rectangular prism to hold the prongs 1033 in position and prevent the prongs 1033 from rotating away from the vertical position when the prongs 1033 are in the vertical position. When the prongs 1033 are being rotated back to the hidden position, the edge of the pivot 1031 are slipping into the concave part 1043 of the locking member 104 and passing therethrough. The physical flexibility of the clamping fixtures 1052 may make it easy and effort-saving to rotate the pivot 1031 and the prongs 1033 from the vertical position to the hidden position. After being rotated back to the hidden position, the pivot 1031 is clamped by the clamping fixtures 1052 on the other two opposite planes of the rectangular prism to prevent the prongs 1033 from rotating out of the lower surface of the lower case 102. Similarly, when the prongs 1033 are to be rotated to the vertical position, the physical flexibility of the clamping fixtures 1052 make it easy and effort-saving to rotate the pivot 1031 and the prongs 1033 from the hidden position to the vertical position.

Furthermore, the pivot 1031 and the circular protrusions 1034 are sandwiched in between the side walls 1056 of the fixing member 105 and the notches 1026 of the lower case 102, and the fixing member 105 is fixed onto the lower case 102 by support of the circular projected hole 1011 of the upper case 101, as shown in FIG. 8. Therefore, the axis of rotation will not be shifted away from the predetermined position and the robustness of the rotatable plug 100 can be increased. Accordingly, the rotatable plug mechanism utilizing the clamping fixtures 1052 and the support of the circular projected hole 1011 in the present invention will be much more stable than prior art utilizing springs. Moreover, the contact surfaces of the side walls 1056, the notches 1026, the pivot 1031, and the circular protrusions 1034 may be polished to reduce the friction therebetween and thereby the rotatable rack 103 can be rotated more smoothly.

Figure 9:
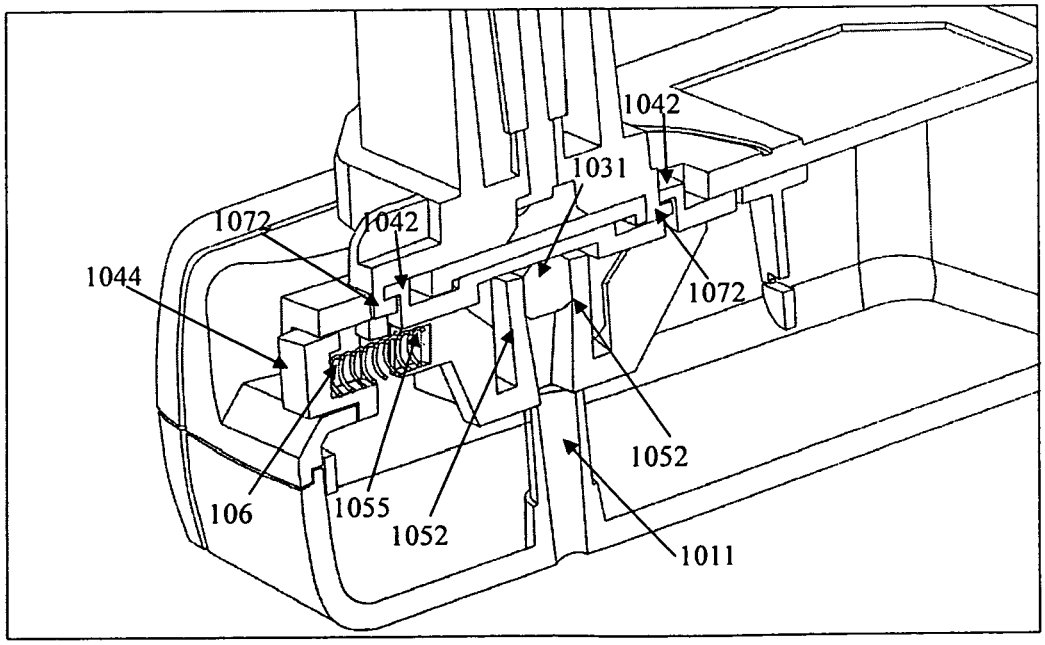
FIG. 9 illustrates the locking mechanism of the rotatable plug with the fixable converter according to the present invention.

With reference to FIG. 9, in the rotatable plug with the fixable converter 10, the locking member 104 can move horizontally through the spring 106 from a first position to a second position. At the first position, the spring 106 is in an expanded condition and the button part 1044 projects from the opening 1028. The ends of the hooks 1072 on the converter 107 enter the notches in the hook locks 1042 of the locking member 104 to fix the converter 107 onto the lower case 102. When the button part 1044 is pushed, the spring 106 is pressured to transform into a compressed condition, so as to render the locking member 104 to move to the second position. At the second position, the spring 106 is in the compressed condition and the outer surface of the button part 1044 is located at the opening 1028. The ends of the hooks 1072 on the converter 107 leave the notches in the hook locks 1042 of the locking member 104, so as to detach the converter 107 from the lower case 102. Therefore, when the locking member 104 is at the second position, the converter 107 can be removed from the lower case 102 of the rotatable plug 100 to replace with other kinds of converter or to hide the prongs 1033 of the rotatable plug 100 into the lower case 102. Furthermore, when the locking member 104 is at the first position, the steadiness of the converter 107 attached on the rotatable plug 100 can be increased because the converter 107 is locked and fixed onto the lower case 102 and will not fall off the rotatable plug 100, such that the user can utilize the rotatable plug with the fixable converter 10 more conveniently and safely. Accordingly, the present invention provides the rotatable plug with the fixable converter 10 which is fixable, replaceable, and safe through the locking member.

Furthermore, because the rotatable plug 100 is rotatable and receivable, the present invention further provides the rotatable plug with the fixable converter 10 in which the rotatable plug 100 is effort-saving, receivable and rotatable, and the converter 107 is fixable and replaceable and meets safety requirements. The rotatable plug with the fixable converter 10 can be applied to any kinds of electric power connector such as a power supply, a battery charger, a transformer, an adapter or any other kinds of electric products which need an electric plug.

With reference to FIG. 10, in the assembling process of the rotatable plug 100 in the present invention, firstly the lower case 102 is pre-prepared. Then, the locking member 104 is placed on the groove 1025 in the lower case 102 and the button part 1044 of the locking member 104 is placed into the opening 1028 in the lower case 102 simultaneously. Subsequently, the rotatable rack 103 is inserted vertically into the two through holes 1023 in the lower case 102 and one end of the spring 106 is inserted into the rectangular cavity 1055 of the fixing member 105. Then, the fixing member 105 is mounted on the lower case 102 to compress the locking member 104 and the rotatable rack 103. Subsequently, the printed circuit board (PCB) 108 and the upper case 101 are attached onto the lower case 102 in sequence to form the rotatable plug 100. Moreover, in the process of attaching the converter 107 onto the rotatable plug 100 in the present invention, firstly the button part 1044 of the locking member 104 is pushed to move the locking member 104 to the second position. Then, the longer ends of the prongs 1033 are inserted into the narrow holes 1073 in the converter 107, and the hooks 1072 on the fixable converter 107 are inserted into the openings 1027 in the lower case 102 simultaneously. Subsequently, the button part 1044 in the locking member 104 is loosened to move the locking member 104 to the first position, such that the converter 107 is fixed on the rotatable plug 100 to form the rotatable plug with the fixable converter 10.

The foregoing description is a preferred embodiment of the present invention. It should be appreciated that this embodiment is described for purposes of illustration only, not for limiting, and that numerous alterations and modifications may be practiced by those skilled in the art without departing from the spirit and scope of the invention. It is intended that all such modifications and alterations are included insofar as they come within the scope of the invention as claimed or the equivalents thereof.

What is claimed is:

1. A structure of a rotatable plug with a fixable converter, comprising:

a lower case including pluralities of through holes formed therein, pluralities of plug receiving slots opened at one end, and pluralities of openings formed between said pluralities of plug receiving slots;

a plug including a longer end to be inserted into said through holes of said lower case, wherein said longer end of said plug is received in said plug receiving slots of said lower case when said plug is rotated to a hidden position;

a locking member placed on said lower case and including pluralities of hook locks formed on the lower surface thereof;

a fixing member including pluralities of clamping fixtures formed on the lower surface thereof to clamp said plug; and a converter including pluralities of hooks formed on the upper surface thereof, wherein said hooks pass through said openings of said lower case and are locked by said hook locks of said locking member.

2. The structure of claim 1, further comprising an upper case engaged with said lower case.

3. The structure of claim 2, wherein said upper case comprises a circular projected hole formed therein.

4. The structure of claim 1, further comprising a printed circuit board attached on said lower case.

5. The structure of claim 1, further comprising a spring disposed between said locking member and said fixing member.

6. The structure of claim 1, wherein said lower case further comprises at least two notches formed therein.

7. The structure of claim 6, wherein said notches are U-shaped.

8. The structure of claim 1, wherein said lower case further comprises a groove formed between said through holes.

9. The structure of claim 1, wherein said plug further comprises a rectangular pivot to be clamped by said clamping fixtures of said fixing member.

10. The structure of claim 9, wherein said plug further comprises two seats formed on opposite ends of said pivot and two circular protrusions fixed to said seats.

11. The structure of claim 1, wherein said locking member further comprises a concave part formed between said pluralities of hook locks.

12. The structure of claim 1, wherein said locking member further comprises a button part formed at one end thereof.

13. The structure of claim 12, wherein said locking member further comprises a cavity formed in the inner side of said button part.

14. The structure of claim 1, wherein said fixing member further comprises two slots formed oppositely in the edge thereof.

15. The structure of claim 1, wherein said fixing member further comprises an inclined board extending downward from one side thereof.

16. The structure of claim 15, wherein said fixing member further comprises a cavity formed at the bottom of said inclined board.

* * * * *